US007259742B2

(12) United States Patent
Chang et al.

(10) Patent No.: US 7,259,742 B2
(45) Date of Patent: Aug. 21, 2007

(54) SOURCE DRIVING CIRCUIT, DISPLAY DEVICE AND METHOD OF DRIVING A SOURCE DRIVER

(75) Inventors: Il-Kwon Chang, Gimpo-si (KR); Yong-Weon Jeon, Suwon-si (KR)

(73) Assignee: Samsung Electronics Co., Ltd, Gyeonggi-do (KR)

( * ) Notice: Subject to any disclaimer, the term of this patent is extended or adjusted under 35 U.S.C. 154(b) by 11 days.

(21) Appl. No.: 11/302,230

(22) Filed: Dec. 14, 2005

(65) Prior Publication Data

US 2006/0125671 A1 Jun. 15, 2006

(30) Foreign Application Priority Data

Dec. 15, 2004 (KR) ..... 10-2004-0106033

(51) Int. Cl.
*G09G 3/36* (2006.01)

(52) U.S. Cl. ..... 345/98; 345/87; 345/100; 341/144

(58) Field of Classification Search ..... 345/87, 345/98, 100; 341/144
See application file for complete search history.

(56) References Cited

U.S. PATENT DOCUMENTS 5,754,156 A * 5/1998 Erhart et al. ..... 345/98
6,753,840 B2 * 6/2004 Aoki ..... 345/98
6,885,358 B2 * 4/2005 Anh ..... 345/98
7,046,256 B2 * 5/2006 Credelle ..... 345/613
2006/0077077 A1 * 4/2006 Kwon ..... 341/50
2006/0109228 A1 * 5/2006 Kang ..... 345/98

FOREIGN PATENT DOCUMENTS

JP 05-289633 11/1993
JP 07-191631 7/1995
KR 1996-0015373 5/1996

* cited by examiner

*Primary Examiner*—Khai M. Nguyen
(74) *Attorney, Agent, or Firm*—Harness, Dickey & Pierce, PLC

(57) ABSTRACT

A source driving circuit for a display device may include a first latch configured to store first video data corresponding to a first horizontal line and a second latch configured to store second video data corresponding to a second horizontal line following the first horizontal line. The first and second latches may alternately store video data of different horizontal lines. The source driving circuit may further include a digital-to-analog converter (DAC) configured to convert the stored first and second video data into analog signals, a first sample-and-hold circuit configured to sample and store an output signal of the DAC, a second sample-and-hold circuit configured to sample and store an output signal of the first sample-and-hold circuit, and an output switch configured to provide an output signal of the second sample-and-hold circuits to the display panel.

18 Claims, 6 Drawing Sheets

SOURCE DRIVING CIRCUIT, DISPLAY DEVICE AND METHOD OF DRIVING A SOURCE DRIVER

PRIORITY STATEMENT

This application claims foreign priority benefits under 35 U.S.C. §§ 119 (a-d) of Korean Patent Application No. 2004-106033, filed on Dec. 15, 2004 in the Korean Intellectual Property Office, the entire contents of which are hereby incorporated by reference.

BACKGROUND OF THE INVENTION

1. Field of the Invention

The present invention relates to a source driving circuit, display device and method of driving a source driving circuit for a display device.

2. Description of the Related Art

Generally, a display driver integrated circuit (IC) outputs high voltage video data to a display panel. The display driver IC receives digital RGB video data from a timing controller, converts the digital RGB video data into a high-voltage analog signal suitable for the display panel, and outputs the high voltage analog signal to the display panel on a horizontal line basis.

As demand for a high-quality image increases, the number of data bits which represent one pixel gradually increases (e.g., 10 bits). Accordingly, this imposes a time restriction so that more bits of data can be processed during a given cycle allocated for data processing of a corresponding horizontal line.

FIG. 1 is a block diagram of a display device including a conventional source driving circuit. Referring to FIG. 1, the display device includes a plurality of conventional source driving circuits 10-1, 10-2, . . . , 10-i, and a display panel 20. Each of the source driving circuits 10-1, 10-2, . . . , 10-i includes a latch 12, a digital-to-analog converter (DAC) 14, a buffer 16, and an output switch SW.

Digital RGB video data and external control signals are provided from a timing controller (not shown), and internal control signals for controlling the source driving circuits 10 are generated using the external control signals. Each of the source driving circuits 10-1, 10-2, . . . , and 10-i corresponds to a given channel. RGB video data corresponding to each of the channels is input into the latch 12 and converted into an analog signal by the DAC 14. The analog signal is output through the buffer 16 and the output switch SW to the display panel 20.

FIG. 2 is a timing diagram illustrating an operation of the source driving circuit illustrated in FIG. 1. Referring to FIG. 2, in response to a horizontal synchronization signal Hsync that is an input signal of the timing controller, RGB video data ( . . . , N−1, N, N+1, N+2, N+3, . . . ) are sequentially input into the source driving circuits 10-1, 10-2, . . . , 10-i of corresponding channels 1, 2, . . . , i. The input data ( . . . , N−1, N, N+1, N+2, N+3, . . . ) are sequentially or simultaneously converted into analog signals at the source driving circuits 10-1, 10-2, . . . , 10-i, and the analog signals are simultaneously output to the display panel 20 through the output switches SW of the source driving circuits 10-1, 10-2, . . . , 10-i.

Referring to FIG. 2 in an example, data N−1 corresponding to a first horizontal line are sequentially input into the source driving circuits 10-1, 10-2, . . . , 10-i during a period I. The input data N−1 are converted into analog signals by the source driving circuits 10-1, 10-2, . . . , 10-i. The analog signals are simultaneously output to the display panel 20 through the output switches of the source driving circuits 10-1, 10-2, . . . , 10-i during a second period II.

Similarly, the data N corresponding to a second horizontal line are sequentially input into the source driving circuits 10-1, 10-2, . . . , 10-i during the period II. The input data N are converted into analog signals by the source driving circuits 10-1, 10-2, . . . , 10-i, and the analog signals are simultaneously output to the display panel 20 through the output switches of the source driving circuits 10-1, 10-2, . . . , 10-i during a third period III.

Accordingly, and as shown in FIG. 2, the conventional source driving circuits 10 operate with a latency of one horizontal synchronization cycle, and thus have to complete the data processing operation for the simultaneous data output to the display panel 20 within one horizontal synchronization cycle. However, where the data processing operation requires a longer time, the time "t1" shown in FIG. 2 for simultaneously outputting valid data to the display panel 20 is inevitably reduced. This problem becomes more serious when a serial capacitor, instead of a resistor string, is used in the DAC 14 in an effort to achieve a high-gray-scale data processing operation and/or a reduced chip area.

SUMMARY OF THE INVENTION

An example embodiment of the present invention is directed to a source driving circuit. The source driving circuit may include a first latch configured to store a portion of first video data corresponding to a first horizontal line, and a second latch configured to store a portion of second video data corresponding to a second horizontal line following the first horizontal line. The first and second latches may alternately store video data of different horizontal lines. The source driving circuit may include a digital-to-analog converter (DAC) configured to convert the stored first and second video data portions into analog signals, a first sample-and-hold circuit configured to sample and store an output signal of the DAC, a second sample-and-hold circuit configured to sample and store an output signal of the first sample-and-hold circuit, and an output switch configured to provide an output signal of the second sample-and-hold circuit to a display panel.

Another example embodiment of the present invention is directed to a display device. The display device may include a display panel, and a plurality of source driving circuits configured to convert received video data into analog output signals for output to the display panel. Each source driving circuit may further include a first latch configured to store first video data corresponding to a first horizontal line and a second latch configured to store second video data corresponding to a second horizontal line following the first horizontal line. The first and second latches may alternately store video data of different horizontal lines. Each source driving circuit may further include a digital-to-analog converter (DAC) configured to convert the stored first and second video data into analog signals, a first sample-and-hold circuit configured to sample and store an output signal of the DAC, a second sample-and-hold circuit configured to sample and store an output signal of the first sample-and-hold circuit, and an output switch configured to provide an output signal of the second sample-and-hold circuits to the display panel.

Another example embodiment is directed to a method of driving a source driver. In the method, first video data of a first horizontal line may be sequentially stored in a first latch, in response to a first horizontal synchronization signal, a first digital-to-analog conversion may be performed on the first video data of the first latch, and a first sample-and-hold operation for sampling and holding analog data resulting from the first digital-to analog conversion may be performed. The method may further include performing, after completion of the first sample-and-hold operation, a second sample-and-hold operation for sampling first output data resulting from the first sample-and-hold operation to provide the sampled first output data to a display panel. Additionally, second video data of a second horizontal line following the first horizontal line may be sequentially stored in a second latch, in response to a second horizontal synchronization signal. The first and second latches may alternately store video data of different horizontal lines. A second digital-to-analog conversion on the second video data of the second latch may be performed, and a third sample-and-hold operation for sampling and holding analog data resulting from the second digital-to-analog conversion may be performed. The method may further include performing, after completion of the third sample-and-hold operation, a fourth sample-and-hold operation for sampling second output data resulting from the third sample-and-hold operation to provide the sampled second output data to the display panel.

Another example embodiment of the present invention is directed to a method of driving a source driver. In the method, video data corresponding to odd and even-numbered horizontal lines may be stored in an alternating fashion in separate memory locations, in response to first and second horizontal synchronization signals. For the video data corresponding to each of the odd and even-numbered horizontal lines that has been stored in alternating fashion in each separate memory location, a digital-to-analog conversion may be performed on the stored video data to generate analog data, a first sample-and-hold operation may be performed for sampling and holding the generated analog data, and after completion of the first sample-and-hold operation, performing a second operation for sampling output data resulting from the first sample-and-hold operation, so as to provide the sampled output data from the second sample-and-hold operation to a display panel.

BRIEF DESCRIPTION OF THE DRAWINGS

Example embodiments of the present invention will become more fully understood from the detailed description given herein below and the accompanying drawings, wherein the like elements are represented by like reference numerals, which are given by way of illustration only and thus are not limitative of the example embodiments the present invention.

DETAILED DESCRIPTION OF THE EXAMPLE EMBODIMENTS

It should be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It should be understood that when an element is referred to as being "connected" or "coupled" to another element, the element can be directly connected or coupled to the other element, or intervening elements may be present coupled or connected elements. In contrast, when an element is referred to as being "directly connected" or "directly coupled" to another element, there are no intervening elements present. Additional terms used to describe the relationship between elements should be interpreted in a like fashion (i.e., "between" versus "directly between", "adjacent" versus "directly adjacent", etc.).

The terminology used herein is for the purpose of describing example embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It should be further understood that terms, such as those defined in commonly used dictionaries, should be interpreted as having a meaning that is consistent with their meaning in the context of the relevant art and will not be interpreted in an idealized or overly formal sense unless expressly so defined herein.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Figure 1:
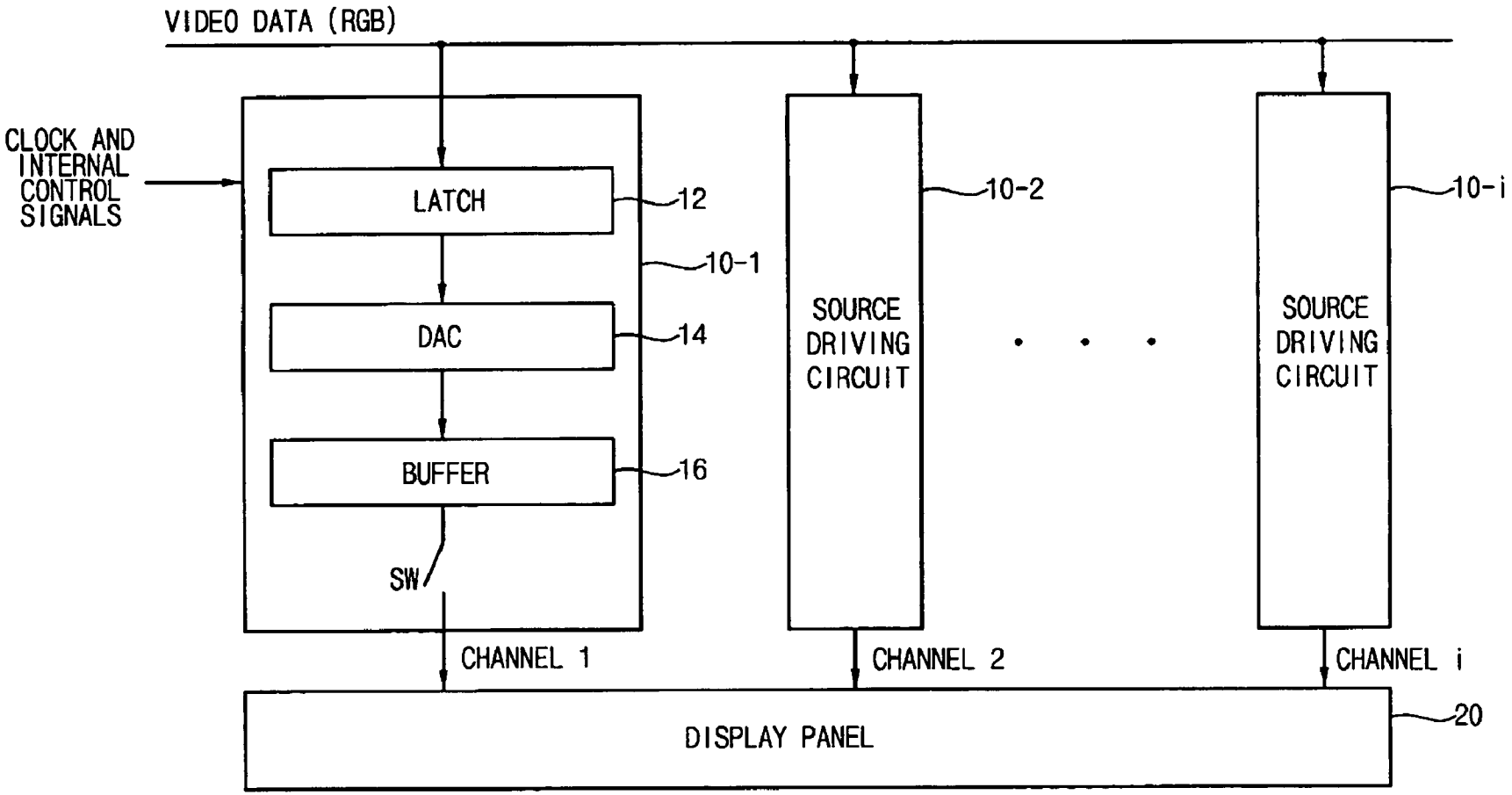
FIG. 1 (CONVENTIONAL ART)
FIG. 1 is a block diagram of a display device including a conventional source driving circuit.
Figure 2:
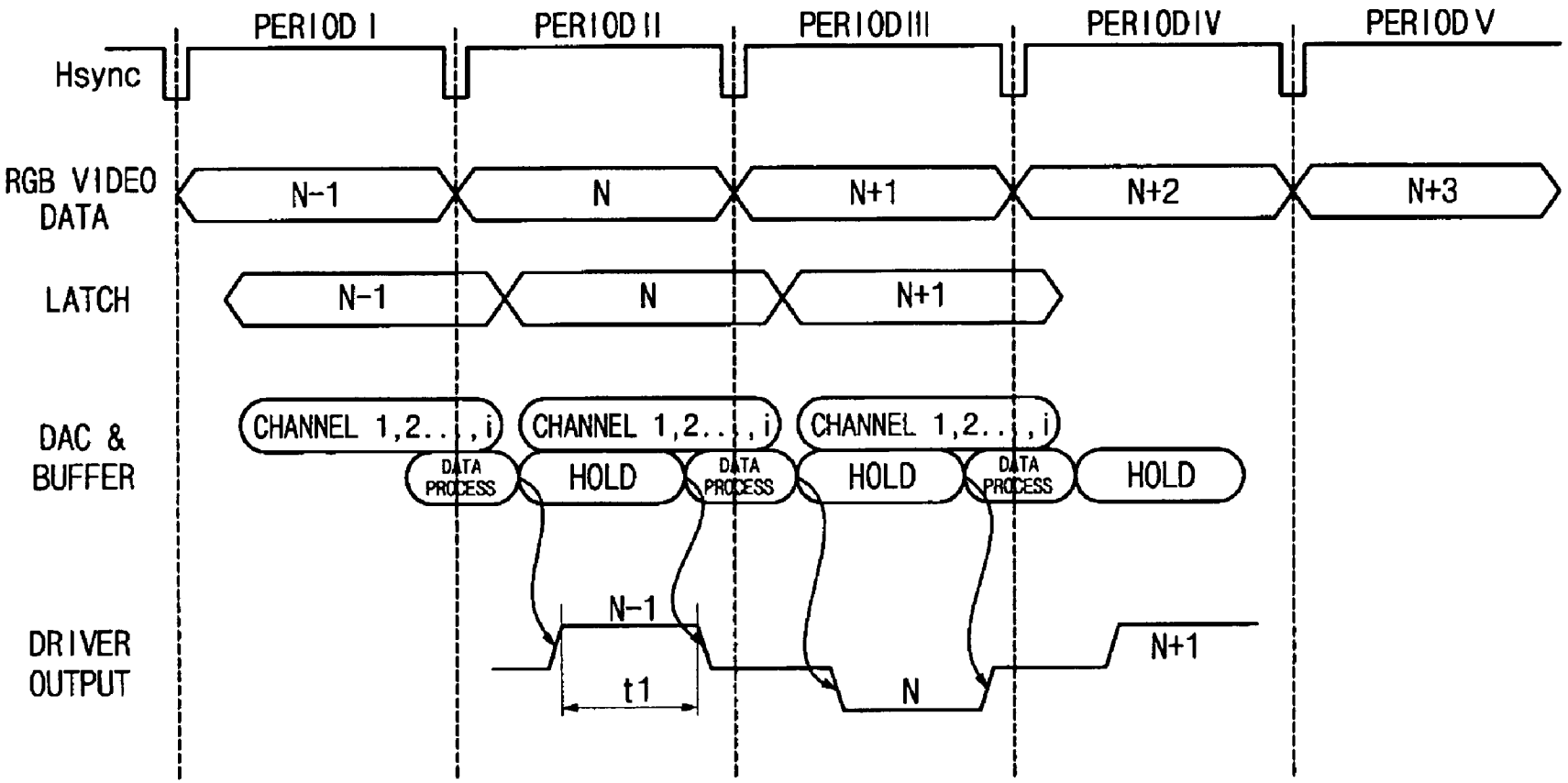
FIG. 2 (CONVENTIONAL ART)
FIG. 2 is a timing diagram illustrating operation of the conventional source driving circuit of FIG. 1.
Figure 3:
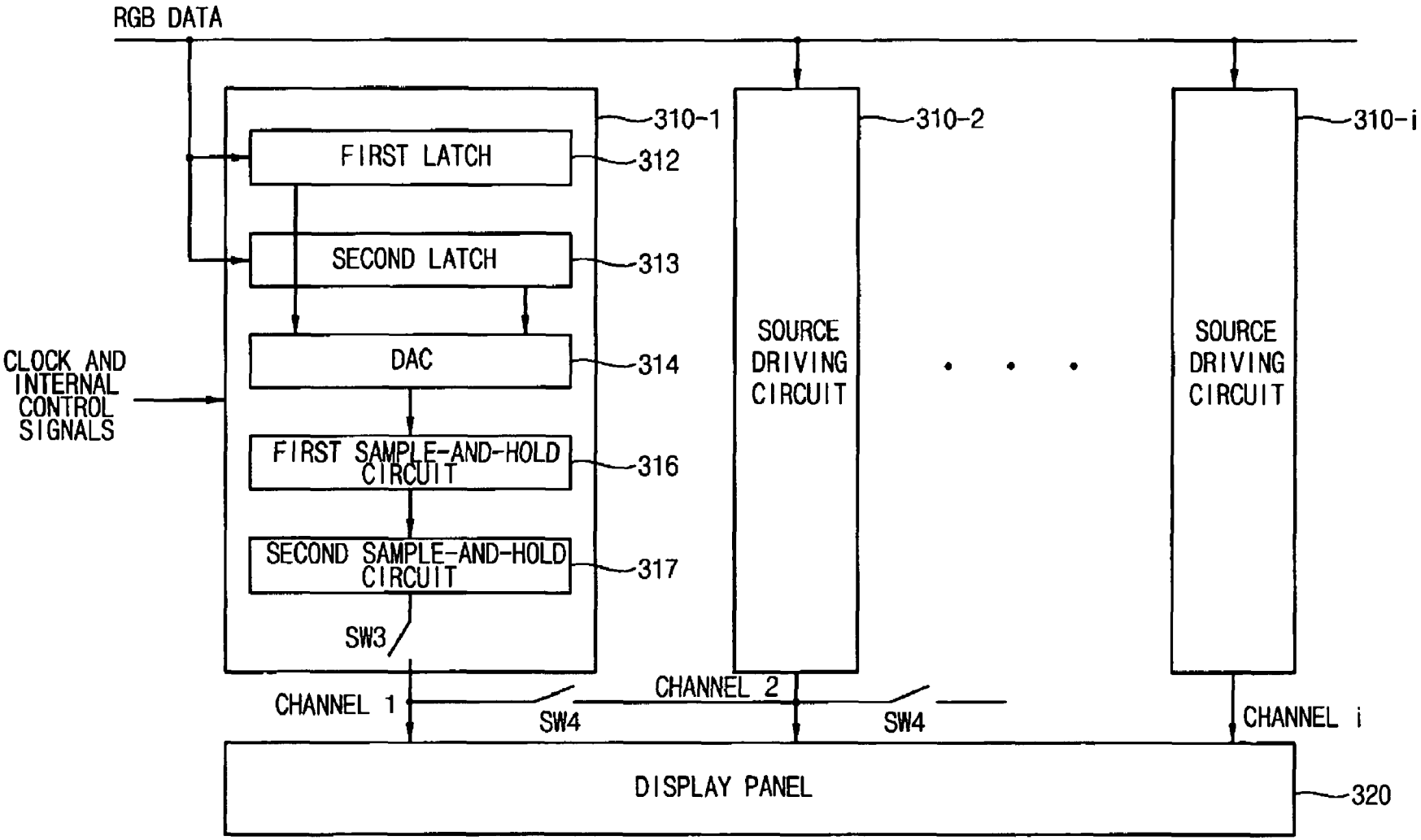
FIG. 3 is a block diagram of a display device including a source driving circuit according to an example embodiment of the present invention.

FIG. 3 is a block diagram of a display device including a source driving circuit according to an example embodiment of the present invention. Referring to FIG. 3, an example display device may include a plurality of source driving circuits 310-1, 310-2, . . . , and 310-i and a display panel 320. Each of the source driving circuits 310-1, 310-2, . . . , and 310-i may include a first latch 312, a second latch 313, a digital-to-analog converter (DAC) 314, a first sample-and-hold circuit 316, a second sample-and-hold circuit 317 and an output switch SW3. In general, the plurality of source driving circuits 310-1, 310-2, . . . , and 310-i are configured to convert received video data signals into analog output signals for driving the display panel 320.

Digital RGB video data (signals) and various external control signals (such as a clock signal, a start data signal, a load signal, and a polarity signal POL) are provided from a timing controller (not shown), and internal control signals for controlling the source driving circuits 310-1, 310-2, . . . , 310-i are generated using the external control signals. Input video data starts to be transmitted to the source driving circuits 310-1, 310-2, . . . , 310-i in response to the start data signal. Data are output from each of the source driving circuits 310-1, 310-2, . . . , 310-i to the display panel 320 in response to the load signal. The polarity signal POL controls line inversion or frame inversion. The DAC 314 simultaneously receives the polarity signal POL and a plurality of gamma reference signals GMA. The first and second sample-and-hold circuits 316 and 317 may sample and hold analog signals output from the DAC 314 in response to the load signal. Each of the source driving circuits 310-1, 310-2, . . . , 310-i may correspond to one channel. Video data (or a portion of the video data) corresponding to each of the channels may be input into one of the first latch 312 and the second latch 313, and converted into an analog signal (e.g., an analog gray-scale voltage) by the DAC 14, based on the gamma reference signals GMA. The analog signal is output to the display panel 20 through one of the first and second sample-and-hold circuits 316, 317 and the output switch SW3.

Figure 4:
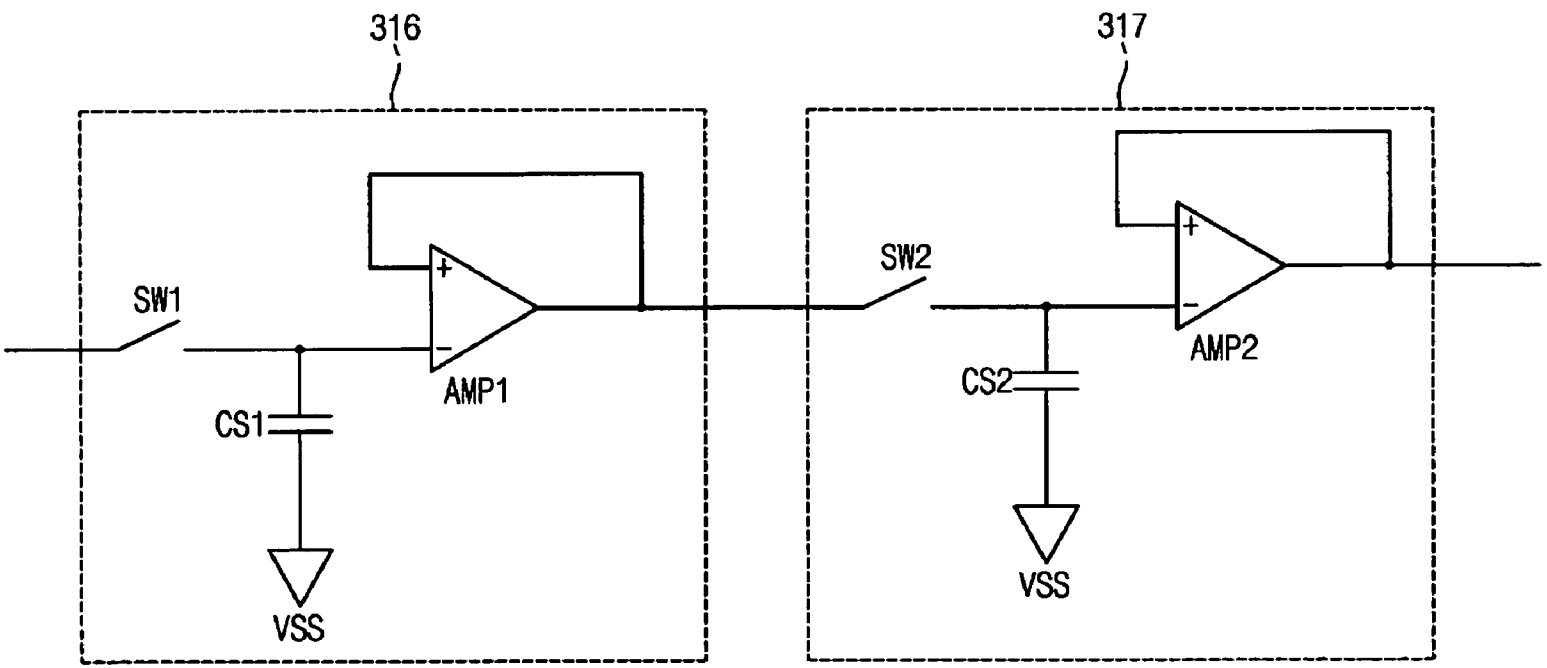
FIG. 4 is a circuit diagram of a sample-and-hold circuit illustrated in FIG. 3.

FIG. 4 is a circuit diagram of the sample-and-hold circuit illustrated in FIG. 3. Referring to FIG. 4, the first sample-and-hold circuit 316 includes a sampling switch SW1, a capacitor CS1 for storing a signal and a source-follower amplifier AMP1. The second sample-and-hold circuit 317 includes a sampling switch SW2, a capacitor CS2 for storing a signal and a source-follower amplifier AMP2. The sampling switches SW1 and SW2 are turned on during a given duration to sample and store data in the capacitors CS1 and CS2, and are turned off after the sampling operations. The sampled data signals stored in the capacitors CS1 and CS2 are driven by the amplifiers AMP1 and AMP2. The sample-and-hold circuits shown in FIG. 4 are known to those skilled in the art, and may be implemented using various combinations of switch and capacitor.

Figure 5:
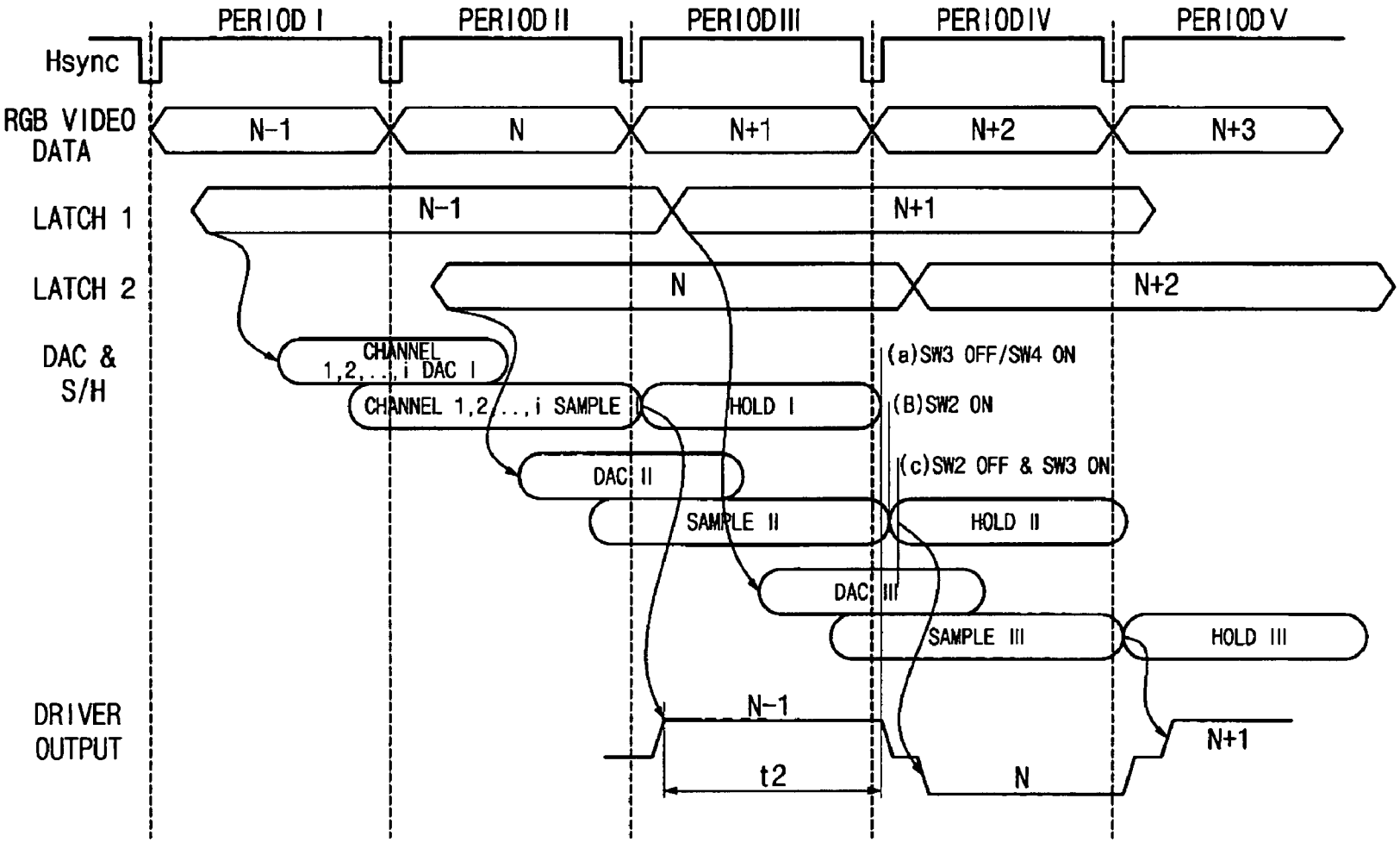
FIG. 5 is a timing diagram illustrating operation of the source driving circuit illustrated in FIG. 3.

FIG. 5 is a timing diagram illustrating operation of the source driving circuit illustrated in FIG. 3. FIGS. 3 and 4 should be occasionally referred to for the following discussion.

Referring to FIG. 5, in response to a horizontal synchronization signal Hsync that represents an input signal of the timing controller, RGB video data N−1 corresponding to a first horizontal line are sequentially input into the source driving circuits 310-1, 310-2, . . . , 310-i of corresponding channels 1, 2, . . . , i during a period I, and are sequentially stored in the corresponding first latches 312 of the source driving circuits 310-1, 310-2, . . . , 310-i. The stored video data N−1 are sequentially converted into analog signals (or analog gray-scale voltages) by the DACs 314 (operation DAC I as shown in FIG. 5). The resulting analog signals are sequentially sampled and stored at the corresponding first sample-and-hold circuits 316 (an operation SAMPLE I as shown in FIG. 5). The operation SAMPLE I may overlap with the operation DAC I, or alternatively may be performed after the operation DAC I is completed.

When the operation SAMPLE I is completed with respect to all of the channels 1, 2, . . . , i, the second sample-and-hold circuits 317 of all the channels start to perform second sampling and storing operations in response to a load signal inputted during a period III. The output switches SW3 of the respective channels are simultaneously turned on to simultaneously output the data N−1 of all the channels to the display panel 320 (operation HOLD I as shown in FIG. 5). The first latch operation, the operation DAC I and the operation SAMPLE I may be performed in response to an external control signal (e.g., a start data signal) that is input in period I. The second sampling and storing operations and the operation HOLD1 may be performed in response to a load signal that is input during period III, after two horizontal synchronization cycles have elapsed from period I, as shown in FIG. 5.

RGB video data N corresponding to a second horizontal line are sequentially input into the source driving circuits 310-1, 310-2, . . . , 310-i of corresponding channels 1, 2, . . . , i during a period II after the period I, and are sequentially stored in the corresponding second latches 313 of the source driving circuits 310-1, 310-2, . . . , 310-i. The stored video data N are sequentially converted into analog signals (e.g., analog gray-scale voltages) by the DACs 314 based on the gamma reference signals GMA (operation DAC II as shown in FIG. 5). The resulting analog signals are sequentially sampled and stored at the corresponding first sample-and-hold circuits 316 (operation SAMPLE II as shown in FIG. 5). The operation SAMPLE II may overlap with the operation DAC II, or may be performed after the operation DAC II.

When the operation SAMPLE II is completed with respect to all the channels 1, 2, . . . , i, the second sample-and-hold circuits 317 of all the channels start to perform second sampling and storing operations in response to a load signal input during a period IV, and then the output switches SW3 of the respective channels are simultaneously turned on to simultaneously output the data N of all the channels to the display panel 320 (operation HOLD II as shown in FIG. 5). As illustrated in the periods III and IV, the data N is output to the display panel 320 in consideration of a timing relationship with the data N−1. That is, before the data N are output in the HOLD II period, the switches SW3 of all the channels are turned off and charge-sharing switches SW4 electrically connecting the outputs of the source driving circuits 310-1, 310-2, . . . , 310-i to one another are turned on so as to perform a charge-sharing operation between the outputs of all the channels.

Thereafter, the sampling switches SW2 of the second sample-and-hold circuits 317 of all the channels are turned on and then turned off after a given sampling time, and the output switches SW3 of all the channels are turned on to output the data N to the display panel 320. At this point, the turning-on/off of the sampling switch SW2, the output switch SW3 and the charge-sharing switch SW4 for the data processing of the second horizontal line are controlled by a load signal input in period IV after two horizontal synchronization cycles from period II have elapsed, as shown in FIG. 5. The sampling switch SW2 of the second sample-and-hold circuit 317 may also be controlled by a control signal input in period II as the corresponding external data are input. The remaining data processing operations on the external data of the respective channels, that is, the latch operation, the operation DAC II and the operation SAMPLE II may be controlled by an external control signal input in period II.

Next, RGB video data N+1 corresponding to a third horizontal line are sequentially inputted into the first latches 312 of the source driving circuits 310-1, 310-2, . . . , 310-i of corresponding channels 1, 2, . . . , i during the period III following period II. The RGB video data N+1 are processed in the same manner (e.g., latch, DAC III, SAMPLE III and HOLD III operations) as the data processing operations in periods I and II.

The first latch 312 and the second latch 313, which may alternately store the data of the respective first (odd-numbered) and second (even-numbered) horizontal lines may be implemented using a shift register and a switch, and thus a detailed description thereof will be omitted for purposes of brevity.

Although the operations DAC I, DAC II, SAMPLE I, and SAMPLE II have been described as sequentially processing the corresponding data, these operations may also be implemented to simultaneously process the corresponding data after completion of data processing operations for all channels in the previous stage.

As described above, the example display device of FIGS. 3–5 includes a plurality of source driving circuits 310-1, 310-2, . . . , 310-i, where each circuit 310-i includes the first and second latches 316, 317 for alternately storing the video data of a corresponding odd-numbered horizontal line (latch 316) and even-numbered horizontal line (latch 317). Thus, RCB video data of the respective horizontal lines may be processed through a "pipelining scheme" by employing a latency of two horizontal synchronization cycles with respect to the respective horizontal lines. In other words, each latch 316, 317 stores the RGB video data of its corresponding horizontal line during the two horizontal synchronization cycles. The data processing operations DAC I, SAMPLE I and HOLD I corresponding to the first horizontal line, and the data processing operations DAC II, SAMPLE II and HOLD II corresponding to the second horizontal line, may thus be performed in the pipelining scheme. The analog signals output from the switches SW3 (e.g., high-gray-scale voltages for driving the display panel 320) are output to the display panel 320 after the two horizontal synchronization cycles, as shown in FIG. 5. Accordingly, a timing margin of the two horizontal synchronization cycles for processing the data corresponding to a given horizontal line can be obtained, thereby facilitating securing a sufficient time "t2" for simultaneously outputting valid data to the display panel 320, as illustrated in the period III of FIG. 5.

This timing margin may become more effective when the DAC 314 is implemented by a serial capacitor so as to achieve a high-gray-scale data processing operation and a reduced chip area. The serial capacitor DAC is well known to those skilled in the art and thus a detailed description thereof will be omitted for purposes of brevity.

Figure 6:
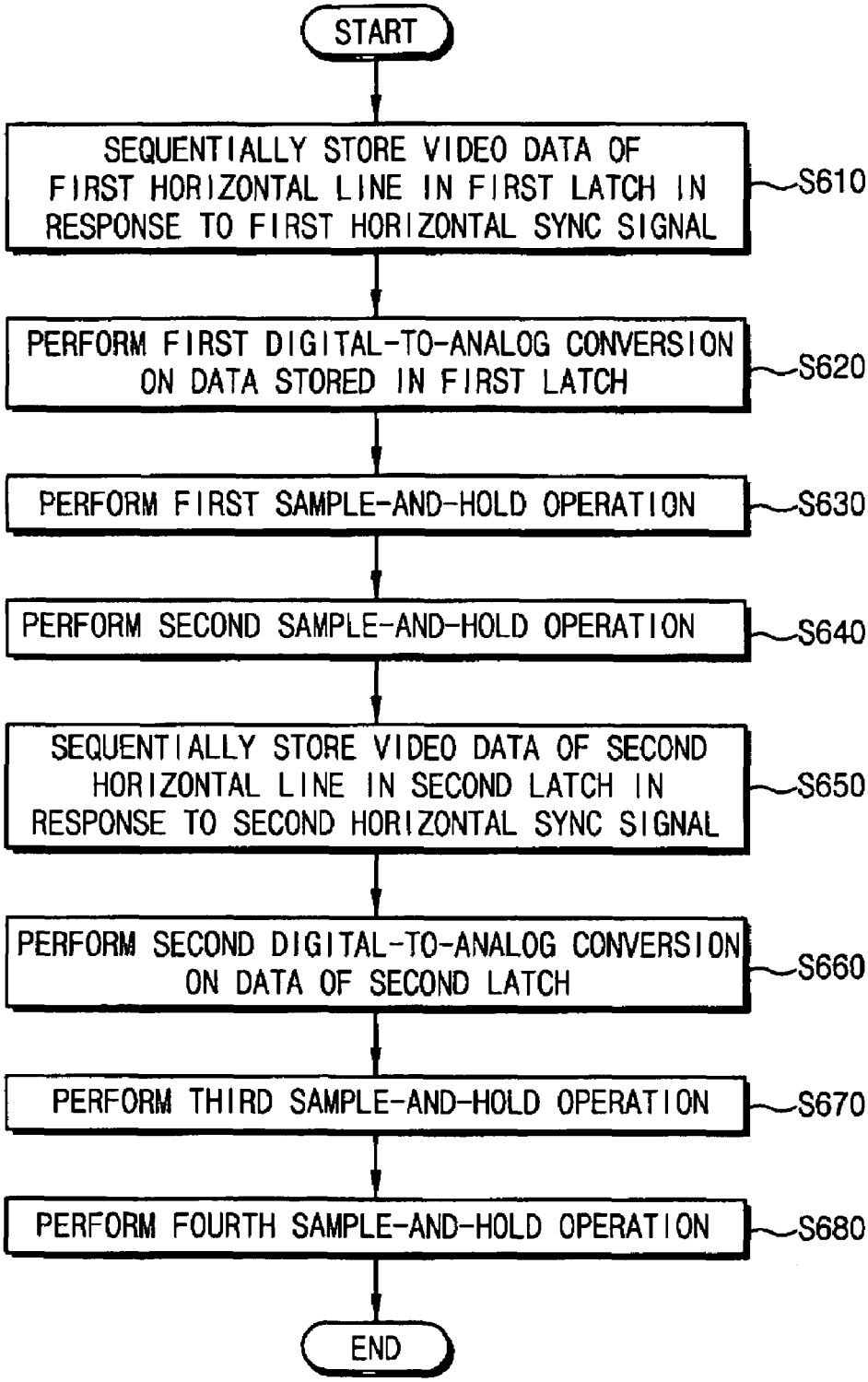
FIG. 6 is a flowchart illustrating a method for driving a source driver of a display device according to an example embodiment of the present invention.

FIG. 6 is a flowchart illustrating a method of driving a source driver for a display device according to an example embodiment of the present invention. Referring to FIG. 6, video data of a first horizontal line are sequentially stored (S610) in a first latch in response to a first horizontal synchronization signal. The stored video data are converted (S620) into first analog data (a first analog conversion operation). The first analog data are sampled and held (S630), (a first sample-and-hold operation). After data processing operations for all data corresponding to the first horizontal line in the first sample-and-hold operation is completed, the output data resulting from the first sample-and-hold operation are sampled and simultaneously output to the display panel via the respective channels (S640), (a second sample-and-hold operation).

Next, video data of a second horizontal line after the first horizontal line may be sequentially stored (S650) in a second latch, in response to a second horizontal synchronization signal. The stored video data may be converted (S660) into second analog data (a second analog conversion operation). The second analog data are sampled and held (S670), (a third sample-and-hold operation). After data processing operations on all data corresponding to the second horizontal line in the third sample-and-hold operation is completed, the output data resulting from the third sample-and-hold operation are sampled and simultaneously output to the display panel via the respective channels (S680), (a fourth sample-and-hold operation). As described above with regard to FIGS. 3 through 5, the first and second latches may alternately store RGB video data of different horizontal lines (e.g., odd-numbered, even-numbered).

As the above operations are identical to those described with reference to FIGS. 3 through 5, a detailed description thereof is omitted for purposes of brevity.

Accordingly, the display device according to an example embodiment of the present invention is equipped with source driving circuits, each including first and second latches for alternately storing the video data of a corresponding odd-numbered horizontal line and even-numbered horizontal line, so that video data of the respective horizontal lines may be processed according to a pipelining scheme that employs a latency of two horizontal synchronization cycles. Thus, a timing restriction for data processing operations can be overcome and a desired time period for data output to the display panel can be secured, leading to potential efficiency improvements in processing high-gray-scale video data.

While the present invention has been described with reference to the example embodiments, it will be apparent to those skilled in the art that various changes and modifications may be made without departing from the spirit and scope of the example embodiments of the invention as defined in the following claims.

What is claimed is:

1. A source driving circuit comprising:

a first latch configured to store a portion of first video data corresponding to a first horizontal line;

a second latch configured to store a portion of second video data corresponding to a second horizontal line following the first horizontal line, wherein the first and second latches alternately store video data of different horizontal lines;

a digital-to-analog converter (DAC) configured to convert the stored first and second video data portions into analog signals;

a first sample-and-hold circuit configured to sample and store an output signal of the DAC;

a second sample-and-hold circuit configured to sample and store an output signal of the first sample-and-hold circuit; and an output switch configured to provide an output signal of the second sample-and-hold circuit to a display panel.

2. The circuit of claim 1, wherein an analog signal that corresponds to the first video data portion is output to the display panel after being delayed by two horizontal synchronization cycles beginning at a point when the first video data portion is input to the source driving circuit.

3. The circuit of claim 2, wherein the analog signal is the output signal of the second sample-and-hold circuit, and the output switch provides the output signal to the display panel in response to a load signal, after the two horizontal synchronization cycles have elapsed.

4. The circuit of claim 1, wherein the DAC includes a serial capacitor.

5. The circuit of claim 1, wherein the first and second latches store first and second video data portions during two horizontal synchronization cycles.

6. The circuit of claim 1, wherein the first and second sample-and-hold circuits each include a sampling switch for sampling data and an amplifier for holding the sampled data.

7. A display device, comprising:

a display panel, and a plurality of source driving circuits configured to convert received video data into analog output signals for output to the display panel, wherein each source driving circuit further includes:

a first latch configured to store first video data corresponding to a first horizontal line;

a second latch configured to store second video data corresponding to a second horizontal line following the first horizontal line, wherein the first and second latches alternately store video data of different horizontal lines;

a digital-to-analog converter (DAC) configured to convert the stored first and second video data into analog signals;

a first sample-and-hold circuit configured to sample and store an output signal of the DAC;

a second sample-and-hold circuit configured to sample and store an output signal of the first sample-and-hold circuit; and an output switch configured to provide an output signal of the second sample-and-hold circuits to the display panel.

8. The device of claim 7, wherein, for each of the source driving circuits, an analog signal that corresponds to the first video data is output to the display panel after being delayed by two horizontal synchronization cycles beginning at a point when the first video data are input to its corresponding source driving circuit.

9. The device of claim 8, wherein the output switches of the source driving circuits simultaneously provide the output signals of the second sample-and-hold circuits to the display panel in response to a load signal, after the two horizontal synchronization cycles have elapsed.

10. The device of claim 7, wherein each of the DACs include a serial capacitor.

11. The device of claim 7, wherein the first and second latches in each of the source driving circuits store the first and second video data during two horizontal synchronization cycles.

12. The device of claim 7, wherein the first and second sample-and-hold circuits in each of the source driving circuits include a sampling switch for sampling data and an amplifier for holding the sampled data.

13. The device of claim 7, wherein each of the DACs and the first sample-and-hold circuits in the source driving circuits sequentially process the first and second video data, and each of the second sample-and-hold circuits in the source driving circuits simultaneously process the first and second video data.

14. A method of driving a source driver, comprising:

sequentially storing first video data of a first horizontal line in a first latch, in response to a first horizontal synchronization signal;

performing a first digital-to-analog conversion on the first video data of the first latch;

performing a first sample-and-hold operation for sampling and holding analog data resulting from the first digital-to-analog conversion;

performing a second sample-and-hold operation for sampling first output data resulting from the first sample-and-hold operation while simultaneously providing the sampled first output data to a display panel, after completion of the first sample-and-hold operation;

sequentially storing second video data of a second horizontal line following the first horizontal line in a second latch in response to a second horizontal synchronization signal, wherein the first and second latches alternately store video data of different horizontal lines;

performing a second digital-to-analog conversion on the second video data of the second latch;

performing a third sample-and-hold operation for sampling and holding analog data resulting from the second digital-to-analog conversion; and performing a fourth sample-and-hold operation for sampling second output data resulting from the third sample-and-hold operation while simultaneously providing the sampled second output data to the display panel, after completion of the third sample-and-hold operation.

15. The method of claim 14, wherein an analog signal that corresponds to the first video data is output to the display panel after being delayed by two horizontal synchronization cycles of the first horizontal synchronization signal, beginning at a time point when the first video data are provided to the source driver.

16. The method of claim 14, wherein the first and second latches respectively store data of corresponding horizontal lines during two horizontal synchronization cycles beginning at a time point when the first and second video data are provided to the source driver.

17. The method of claim 14, wherein the first and second digital-to-analog conversion and the first and third sample-and-hold operations sequentially process the video data.

18. A method of driving a source driver, comprising:

alternating the storing of video data corresponding to odd and even-numbered horizontal lines in separate memory locations in response to first and second horizontal synchronization signals, and for video data corresponding to each of said odd and even-numbered horizontal lines that has been stored in alternating fashion in each separate memory location:

performing a digital-to-analog conversion on the stored video data to generate analog data, and performing a sample-and-hold operation for sampling and holding said generated analog data.

* * * * *